US005946865A

United States Patent [19]

Raychman

[11] Patent Number: 5,946,865

[45] Date of Patent: Sep. 7, 1999

[54] DYNAMIC BUILDING SUPPORT STRUCTURE AND METHOD FOR BUILDING THE SAME

[76] Inventor: Leon Raychman, 10 Minachalim Bhar Street, Ramot Motza, Israel

[21] Appl. No.: 08/761,537

[22] Filed: Dec. 6, 1996

[30] Foreign Application Priority Data

Dec. 7, 1995 [IL] Israel ..... 116284

[51] Int. Cl.[6] ..... E04H 9/02

[52] U.S. Cl. ..... 52/167.1

[58] Field of Search ..... 52/167.1

[56] References Cited

U.S. PATENT DOCUMENTS

| | | | |
|---|---|---|---|
| 929,542 | 7/1909 | Boermel | 52/167.1 X |
| 1,088,239 | 2/1914 | Paine | 52/167.1 X |
| 3,761,068 | 9/1973 | Suh | 52/167.1 X |
| 3,794,277 | 2/1974 | Smedley et al. | 52/167.1 X |
| 3,986,367 | 10/1976 | Kalpins | 52/167.1 X |
| 3,998,062 | 12/1976 | Lange | 52/167.1 X |
| 4,697,395 | 10/1987 | Peek | 52/167.1 |
| 4,974,378 | 12/1990 | Shustov . | |
| 5,353,559 | 10/1994 | Murota et al. . | |

FOREIGN PATENT DOCUMENTS

| | | |
|---|---|---|
| 2021031 | 8/1971 | Germany . |
| 3819591 A1 | 12/1989 | Germany . |
| 2121249 | 11/1971 | South Africa . |

*Primary Examiner*—Christopher Kent
*Attorney, Agent, or Firm*—Reising, Ethington, Barnes, Kisselle, et al

[57] ABSTRACT

An above-surface topple-able and self-righting dynamic building support structure having an external loadbearing shell including a bottom base and upwardly and outwardly sloping curved sidewalls extending from a periphery of the base to an upper portion. The bottom base enables the building support structure to be supported on a substantially planar surface in a datum state of stable equilibrium in which the bottom base is in loadbearing contact with same. The sidewalls define a suitable curvature for enabling the building support structure to roll reversibly about a horizontal axis over the surface while at least a portion of the sidewalls is in loadbearing contact with the surface. The dynamic building support structure also comprises self-righting means capable of generating a net moment in a direction opposed to the direction of rolling of the building support structure in the absence of external forces.

30 Claims, 11 Drawing Sheets

DYNAMIC BUILDING SUPPORT STRUCTURE AND METHOD FOR BUILDING THE SAME

FIELD OF INVENTION

The present invention relates to the field of construction of building structures and the foundations thereof, in particular with the rendering of such structures earthquake-proof.

BACKGROUND

The construction of a building structure traditionally comprises three stages:

(i) earthscraping;

(ii) construction of an underground foundation structure;

(iii) construction of building structure atop said foundation structure.

A building structure is designed to carry vertical loads arising from the weight of the actual structure including the contents therein and associated normative mobile forces, and these loads are conventionally supported by a foundation structure which is rigidly embedded underground. However, traditional building construction methods and techniques have, in the main, proved inadequate in preserving the structural integrity of such structures during and following the application of strong horizontal forces, such as arise from seismic shocks for example, as is evident from the extensive structural damage suffered by many buildings during the recent Los Angeles and Kobe earthquakes. Typically, a strong horizontal force acting on a building structure tends to induce a toppling moment on the structure, causing at least part of the underground foundation structure to become uprooted, thereby irreversibly destabalising the upper structure, and causing partial or total collapse of the building structure. Furthermore, the phenomenon of liquefaction, common with earthquakes, is also responsible for widespread damage. The shaking of the ground causes soil to settle, driving gas and water towards the surface, reducing the ability of foundation structures to support buildings. Furthermore, the foundation structures become destabilised and are weakened, leading to the disintegration of the same and of the building structures atop them.

Attempts have been made to render buildings "earthquake-resistant", for example by increasing the strength of a given building structure, particularly by the incorporation of additional steel reinforcement within a reinforced-concrete type of structure. However, increasing the ability of a building structure to resist the effects of an earthquake may only provide a limited solution, since seismic forces greater than the design magnitude for any particular building, resisted by a relatively inflexible structure, will lead to major structural damage, even total collapse, of the same.

Newsweek magazine (Jan. 30, 1995) discusses alternative earthquake-resistance techniques including "seismic isolation", in which a building lies on top of steel and rubber pads, which effectively minimise relative movement between the structure and foundation; the pads act as shock absorbers, reducing the amount of ground motion that gets transmitted to a structure during an earthquake. Nevertheless, though the building may further be designed to be flexible in order to absorb some of the energy associated with the seismic shock by swaying, there still remains a substantial element of resistance against the swaying, ultimately leading to structural damage if the shock is strong enough. Furthermore, the foundation structures are still rigidly embedded underground, albeit "insulated" from it to a degree, and may suffer the same fate as conventional buildings if a large-enough seismic shock is applied thereto. Additionally, such techniques do not provide adequate protection against liquefaction, wherein one part of the foundation may experience more movement than another part, leading to the eventual disintegration of the same.

An aim of the present invention is to provide a foundation structure for building structures and the like which is substantially earthquake-proof while not being subject to the above-mentioned limitations.

A further aim of the present invention is to provide a suitable building support structure onto which a predetermined—including conventional—building structure, may be mounted, which enables the same to "ride out" the effects of a predetermined horizontal force to a much greater extent than is possible with conventional or flexible building structures.

A further aim of the present invention is to provide a suitable building support structure wherein the impact energy associated with the application of a strong horizontal force on same may be effectively dissipated by the conversion of said energy into rotation kinetic energy of said support structure by the rolling motion thereof, thereby minimising corresponding impact stresses on, and substantially preserving the structural integrity of, said building support structure including any predetermined ancillary structure that may be optionally rigidly attached thereto, further enabling the same to roll back to substantially the same position and attitude that existed prior to application of said force.

A further aim of the present invention is to provide a suitable building support structure onto which a building structure may be mounted, wherein said building support structure may roll along and/or be displaced along the ground, while providing structural support for said building structure.

A further aim of the present invention is to provide a building structure comprising an integral building support structure having any or all of the above-mentioned characteristics.

A further aim of the present invention is to provide a method for building an earthquake-proof building support structure for a building structure.

A further aim of the present invention is to provide a method for building a single earthquake-proof building support structure for a plurality of building structures.

A further aim of the present invention is to provide a method for building an earthquake-proof building structure.

Briefly stated, these aims are accomplished via a revolutionary approach to the support of building structures, wherein rather than following the traditional method of setting building structures atop static foundations rigidly embedded in the ground, an above-ground dynamic support structure enables building structures to be supported while remaining independent of the ground, thereby effectively permitting relative movement to occur between the building structure and the ground. Thus, said building support structure, rather than stiffly resisting a seismic shock applied thereto, is able to ride out the effects of the shock, by using the momentum imparted to it by the shock, and therefore the associated energy of same, to initiate movement of the building support structure over the surface, including reversible rolling about a horizontal axis over the same and optionally including translation over same and/or rotation about a vertical axis over the same, thereby dissipating the energy of the seismic shock in a more controlled manner than hitherto possible, thus substantially maintaining the structural integrity of the building structure.

SUMMARY OF THE INVENTION

An above-surface toppleable and self-righting dynamic building support structure comprising: an external loadbearing shell including a bottom base and upwardly and outwardly sloping curved sidewalls extending from the periphery of said base to an upper portion, wherein: said bottom base enables said building support structure to be supported on a suitable surface in a datum state of stable equilibrium, wherein said bottom base is in loadbearing contact with same; and said sidewalls define a suitable curvature for enabling said building support structure to roll reversibly about a horizontal axis over said surface, wherein at least a portion of said sidewalls is in loadbearing contact therewith. Said dynamic building support structure also comprises self-righting means capable of generating a net moment in a direction opposed to the direction of rolling of said building support structure in the absence of external forces. Said building support structure is in a datum state of steady equilibrium until an external substantially horizontal predetermined force is applied thereto, whereby: said building support structure topples and rolls reversibly over said surface, thereby substantially absorbing the impact energy associated with said horizontal force and minimising corresponding impact stresses on, and substantially preserving the structural integrity of, said building support structure including any predetermined ancillary structure that may be optionally rigidly attached thereto; and said self-righting means return the said building support structure to said datum state of steady equilibrium state after said external horizontal force is removed.

DESCRIPTION

The present invention relates to an above-surface toppleable and self-righting dynamic building support structure comprising:

(I) an external loadbearing shell including a bottom base and upwardly and outwardly sloping curved sidewalls extending from the periphery of said base to an upper portion, wherein:

(i) said bottom base enables said building support structure to be supported on a suitable surface in a datum state of stable equilibrium, wherein said bottom base is in loadbearing contact with same; and (ii) said sidewalls define a suitable curvature for enabling said building support structure to roll reversibly about a horizontal axis over said surface, wherein at least a portion of said sidewalls is in loadbearing contact therewith;

(II) self-righting means capable of generating a net moment in a direction opposed to the direction of rolling of said building support structure in the absence of external forces;

wherein said building support structure is in a datum state of steady equilibrium until an external substantially horizontal predetermined force is applied thereto, whereby:

(a) said building support structure topples and rolls reversibly over said surface, thereby substantially absorbing the impact energy associated with said horizontal force and minimising corresponding impact stresses on, and substantially preserving the structural integrity of, said building support structure including any predetermined ancillary structure that may be optionally rigidly attached thereto; and (b) said self-righting means return the said building support structure to said datum state of steady equilibrium state after said external horizontal force is removed.

Figure 1:
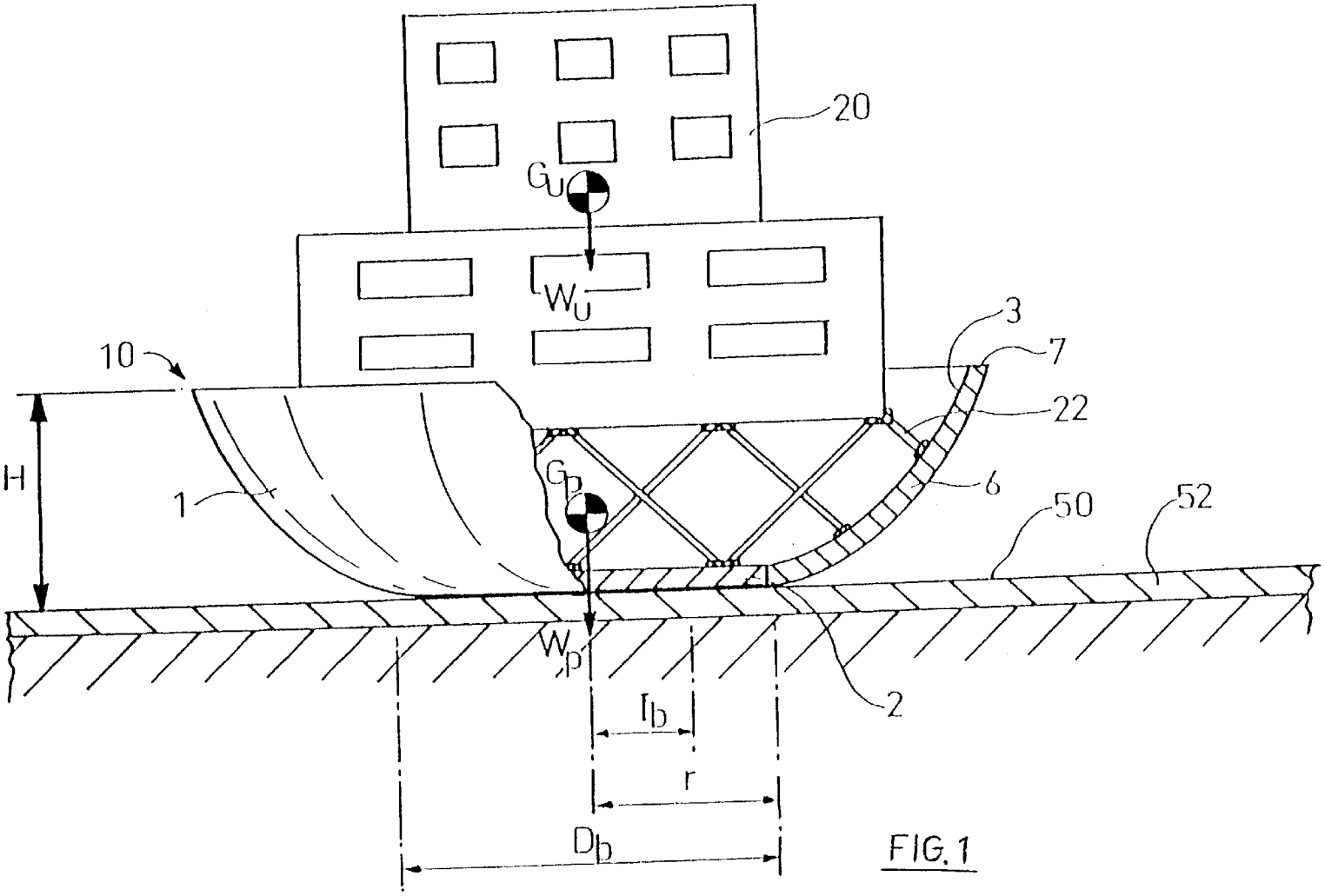
FIG. 1 illustrates the first embodiment of the present invention in partially fragmented side view.

Thus with reference to FIG. 1, in a first embodiment of the present invention, the building support structure generally designated (10) comprises an upwardly open loadbearing shell (1) defined by a horizontal, planar bottom base (2) having a circular periphery, and an outwardly and upwardly sloping curved sidewalls (6) joined thereto and extending therefrom to an upper portion (7), forming a continuous frustro-convex sidewall surface. Said upper portion (7) comprises an upper periphery parallel to the periphery of the said bottom base, and of a similar profile thereto, i.e., a horizontal circular periphery. In the absence of external substantially horizontal forces, the said building support structure (10) sits atop a substantially planar and horizontal surface (50), with bottom base (2) in loadbearing contact thereto. Advantageously, said horizontal surface (50) optionally comprises an upper layer (52) of vibration-dampening material such as rubber, of suitable thickness.

Figure 6:
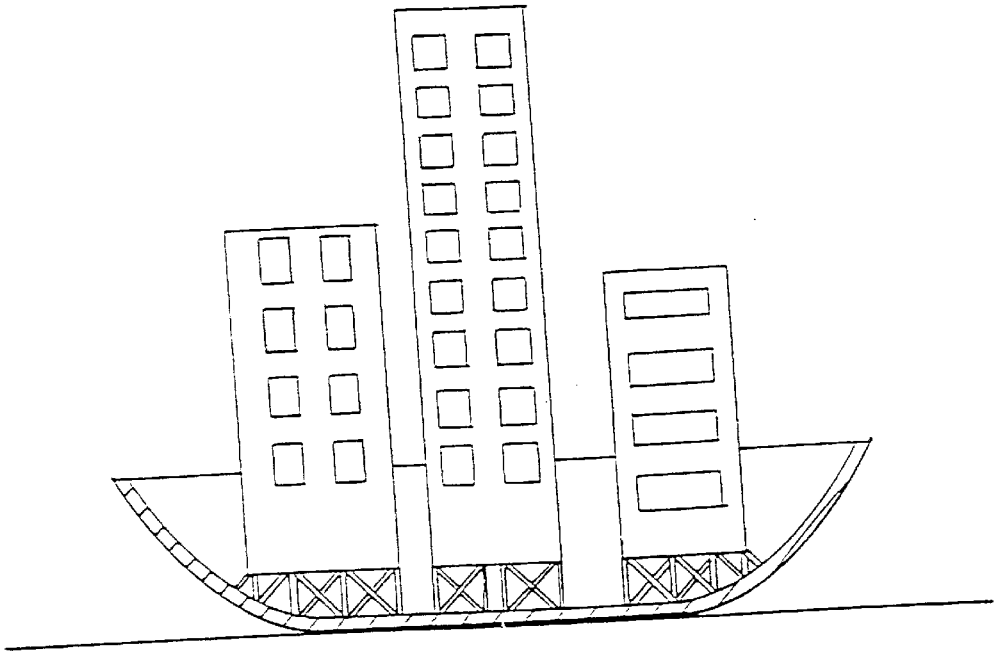
FIG. 6 illustrates a plurality of upper structures suitably mounted to each of the embodiments shown in FIGS. 1 and 4.
Figure 6:
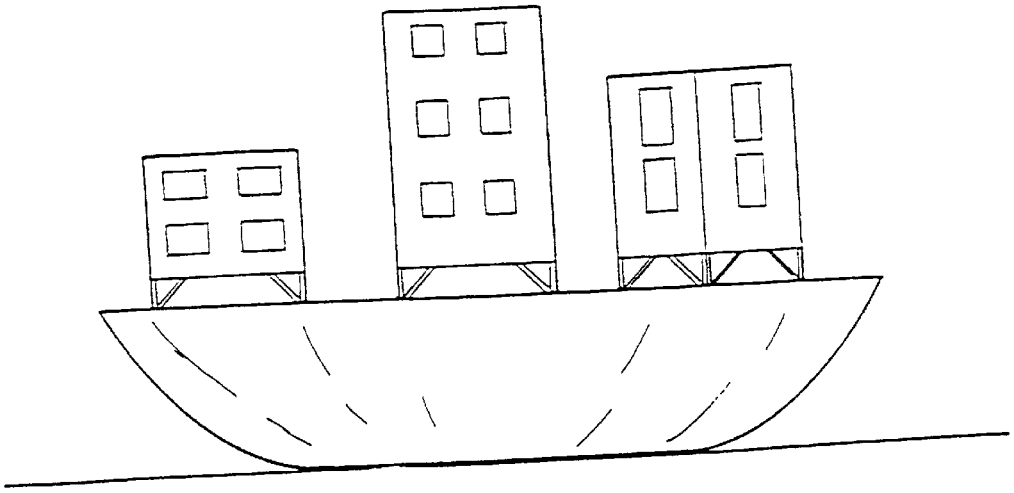

The shell (1) further comprises suitable attachment means (22) on the inner surface (3) for rigidly mounting thereto a predetermined ancillary upper structure (20) to form a combined structure, having dynamic properties of a corresponding rigid body, wherein relative movement between said ancillary upper structure (20) and said building support structure (10) is substantially prevented. Said upper structure (20) has a total weight (Wu), including contents, acting through its centre of gravity (Gu) and is mounted onto said building support structure (10) by means of said attachment means (22). The term "upper structure" is used herein to generally encompass all types of building structures, including conventional and custom residential, business, industrial structures and also any service structures such as electric grid pylons and the like. Furthermore, the term "upper structure", though in the singular, is used herein to further include a plurality of building structures, each as hereinbefore defined, and mounted to a single building support structure (1), as illustrated in FIG. 6.

Figure 2:
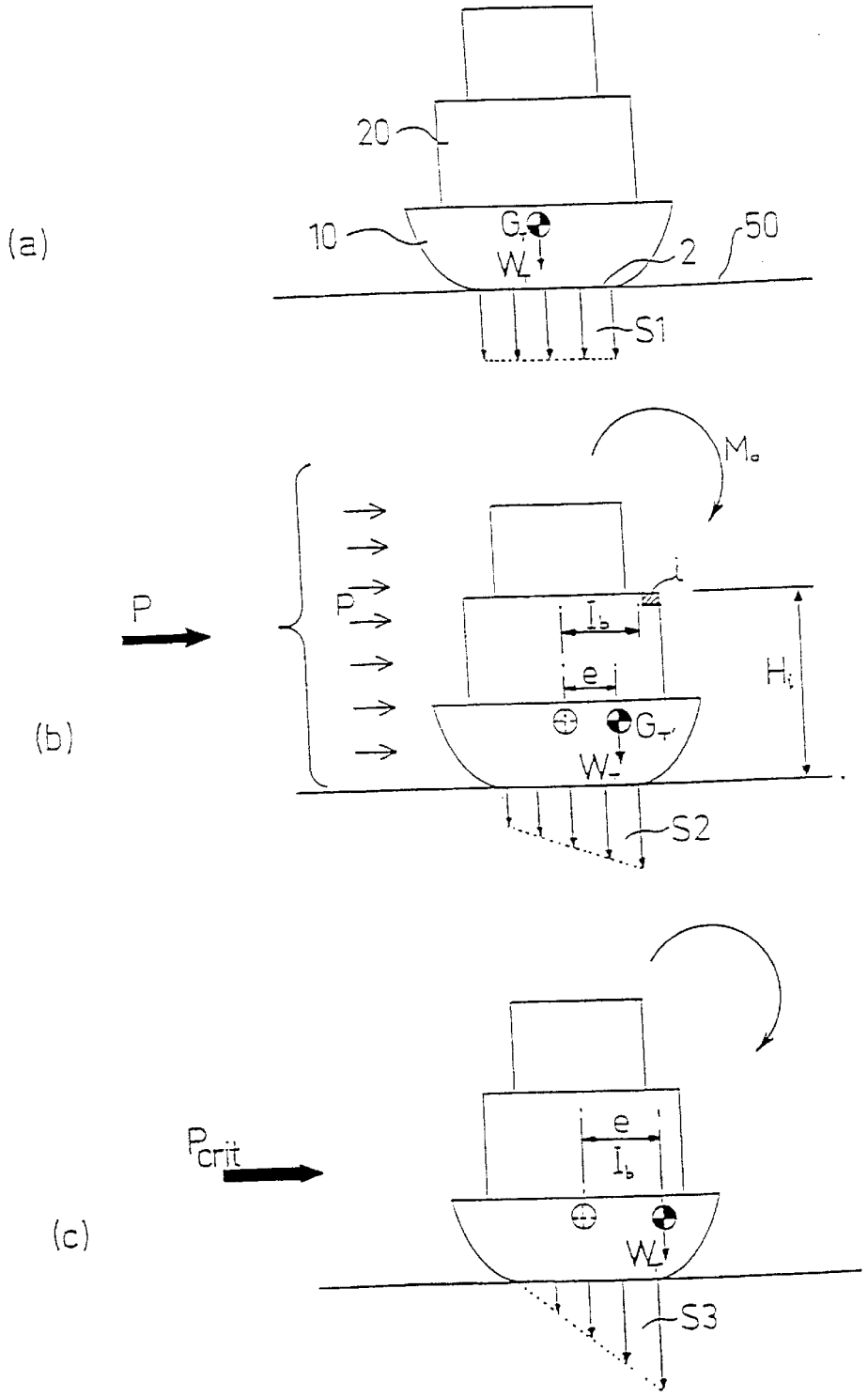
FIG. 2 illustrates the effect of a substantially horizontal predetermined force on the distributions of load on the loadbearing bottom wall of a building support structure according to the present invention.

The building support structure (10) operates as follows. In the absence of external substantially horizontal forces, the building support structure (10) acts as a foundation structure for the upper structure (20), supporting its own weight and the weight of the said upper structure (20) and contents therein via loadbearing contact of said bottom base (2) with said surface (50), FIG. 2(*a*). When a horizontal force, (P), resulting from a seismic disturbance for example, is applied onto the said combined structure, initially a redistribution of the load carried on the bottom base (2) occurs, from a nominally symmetrical distribution (S1) to a biased distribution (S2) wherein more of the load will be carried in the direction of the force (P), FIG. 2(*b*). A topping moment, (Mo) is induced, given by:

$$Mo=\Sigma(Pi*Hi)$$

wherein the right hand side of this equation represents the summation of the moments given by the arithmetic product of the horizontal force (Pi) action on each element (i) of the combined structure and the vertical distance (Hi) of the said element (i) from the point of contact with the horizontal surface (50). Correspondingly, the centre of gravity of (Gt) the combined structure is horizontally displaced in the direction of the horizontal force (P) by an amount (e) given by:

$$(e)=(Mo)/(Wt)$$

wherein (Wt) is the weight of the combined structure. So long as the magnitude of (P) is less than a critical value (Perit), the displacement (e) will remain within the radius of nucleus (Ib) of the bottom base, the combined structure will remain in a datum state of stable equilibrium, and no tensile forces act on the base, said radius of nucleus (Ib) being given by:

$$(Ib)-(r/4)=(Db/8)$$

wherein (r) and (Db) represent the actual or effective radius and diameter, respectively, of the said bottom base. At a critical magnitude (Perit) of force (P), one end of the bottom base (2), while still in nominal contact with the surface (50), will no longer carry any load, as shown in the critical distribution (S3) in FIG. 2(*c*), wherein:

$$(e)=(Ib)$$

Figure 3:
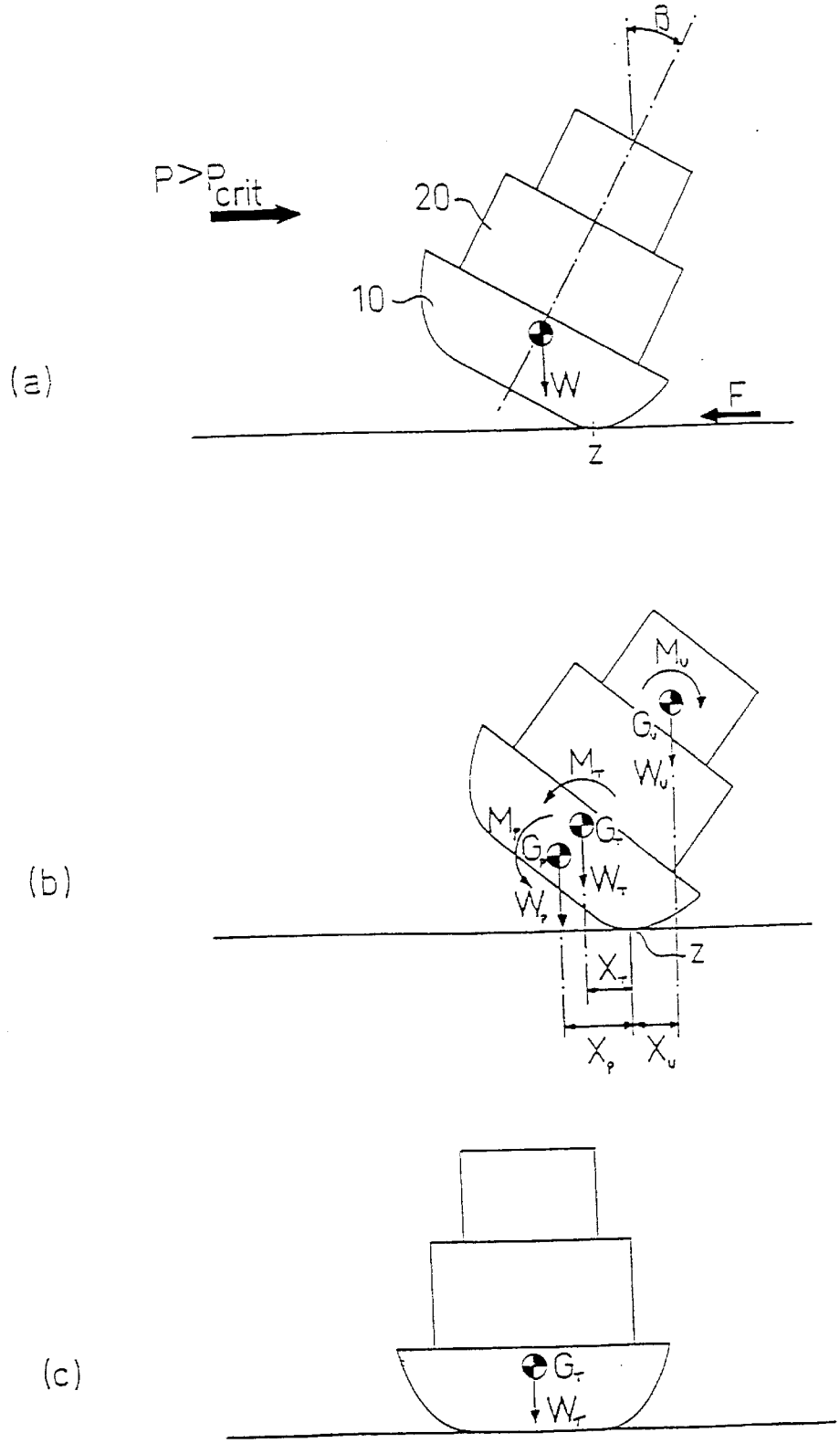
FIG. 3 illustrates the rolling dynamics of the building support structure of the present invention in relation to a substantially horizontal predetermined force applied thereto.

Any further increase in the magnitude of (P) results in the building support structure (10) beginning to roll, substantially in the direction of the force (P), as illustrated in FIG. 3(*a*). The angle of roll, β, will then be determined by the magnitude and duration of the horizontal force (P), as well as frictional losses (F) between the building support structure (10) and the surface (50) which arise as a result of the rolling motion. The geometry of the building support structure (10), particularly the height (H) thereof and the curvature of the sidewalls (6) along vertical planes, is chosen to ensure that the line of action of the total weight (Wt) always acts through a part of the sidewalls (6) in loadbearing contact with the surface (50) for the maximum roll angle resulting from the maximum expected horizontal force (Pmax).

Thus, as the combined structure beings its rolling motion, the impact energy of the horizontal force (P), rather than being actively resisted by the upper structure (20) and a conventional static foundation, is instead dissipated, first by the redistribution of the load carried on the bottom base (2), and then by the rolling motion of the combined structure over surface (50). When the horizontal force (P) is eventually removed, FIG. 3(*b*), the combined structure will have tilted through an angle, say β°max, from the vertical, where β°max is generally between 0° and 90°, and combined structure is at that instance supported at a portion (z) along the said convex wall (6). The upper structure (20) then has a moment (Mu) given by:

$$(Mu)=(Wu*Xu)$$

wherein in the worst case (Mu) is positive in the direction of roll, and (Wu*Xn) is the product of its weight (Wu) and the horizontal displacement (Xu) of the corresponding center of gravity (Gu) from the centre of portion (z) of the convex wall (6). Conversely, the building support structure (10) has a moment (Mp) which is positive in a direction opposed to the direction of roll, and is given by:

$$(Mp)=(Wp*Xp)$$

wherein (Wp*Xp) represents the product of its weight (Wp) and the horizontal displacement (Xp) of the corresponding center of gravity (Gp) from the centre of portion (z) of the sidewalls (6).

The difference ((Mp)−(Mu)) represents the net moment provided by the said self-righting means, which in this embodiment comprises the sum of the said weights (Wu) and (Wp), i.e., (Wt).

Said differently, at least for a predetermined range of roll angles, said self-righting means in this embodiment comprises the total weight (Wt) of the said building support structure including any said predetermined ancillary structure (i.e. said upper structure (20)) that may be optionally rigidly attached thereto, acting through the centre of gravity (Gt) thereof, wherein said centre of gravity (Gt) is horizontally displaced by a displacement (Xt) from the centre of said portion (z) of said sidewall (6) in loadbearing contact with the said surface (50), in a direction opposed to the direction of said predetermined horizontal force (P), wherein a net moment (Mt) is provided given by:

$$(Mt)=(Wt)*(Xt)$$

i.e., the arithemtic product of said weight (Wt) and said displacement (Xt), said net moment (Mt) being positive in a direction opposed to the direction of said predetermined horizontal force (P) and wherein:

$$(Mt)=((Mp)-(Mu))$$

The said upper structure is predetermined at least to the extent that for a given building support structure, the weight distribution and dimensions of said upper structure are such that the moment (Mu) will always be less than the moment that can be generated by the self-righting means, wherein in this embodiment the corresponding net moment, ((Mp)−

(Mu)) is positive. Alternatively, for a predetermined building structure, a building support structure having suitable dimensions and weight distribution is required for ensuring that ((Mp)−(Mu)) remains positive.

Additionally, the dimensions and weight distribution of the upper structure (20) are advantageously chosen to minimise the magnitude of the moment (Mu), and similarly the weight (Wp) of the building support structure, and therefore the corresponding moment (Mp), may be maximised by the use of filler (9), and/or further enhanced by the use of spring means (60), as hereinafter described. Hence, in this embodiment, (Mp) is always greater than (Mu), i.e. (Mt) is positive for the full predetermined range of roll angles.

Thus a net moment in a direction opposed to the direction of roll, given by (Mt), or the difference ((Mp)−(Mu)), initiates rolling motion in the reverse direction to the said horizontal force, substantially restoring the combined structure to its original vertical orientation and position, FIG. 3(*c*). As the reverse rolling progresses, (Xp) and (Xu) both diminish in a relative relationship determined by the curvature of the convex wall (6) in relation to that of the surface (50).

Figure 4:
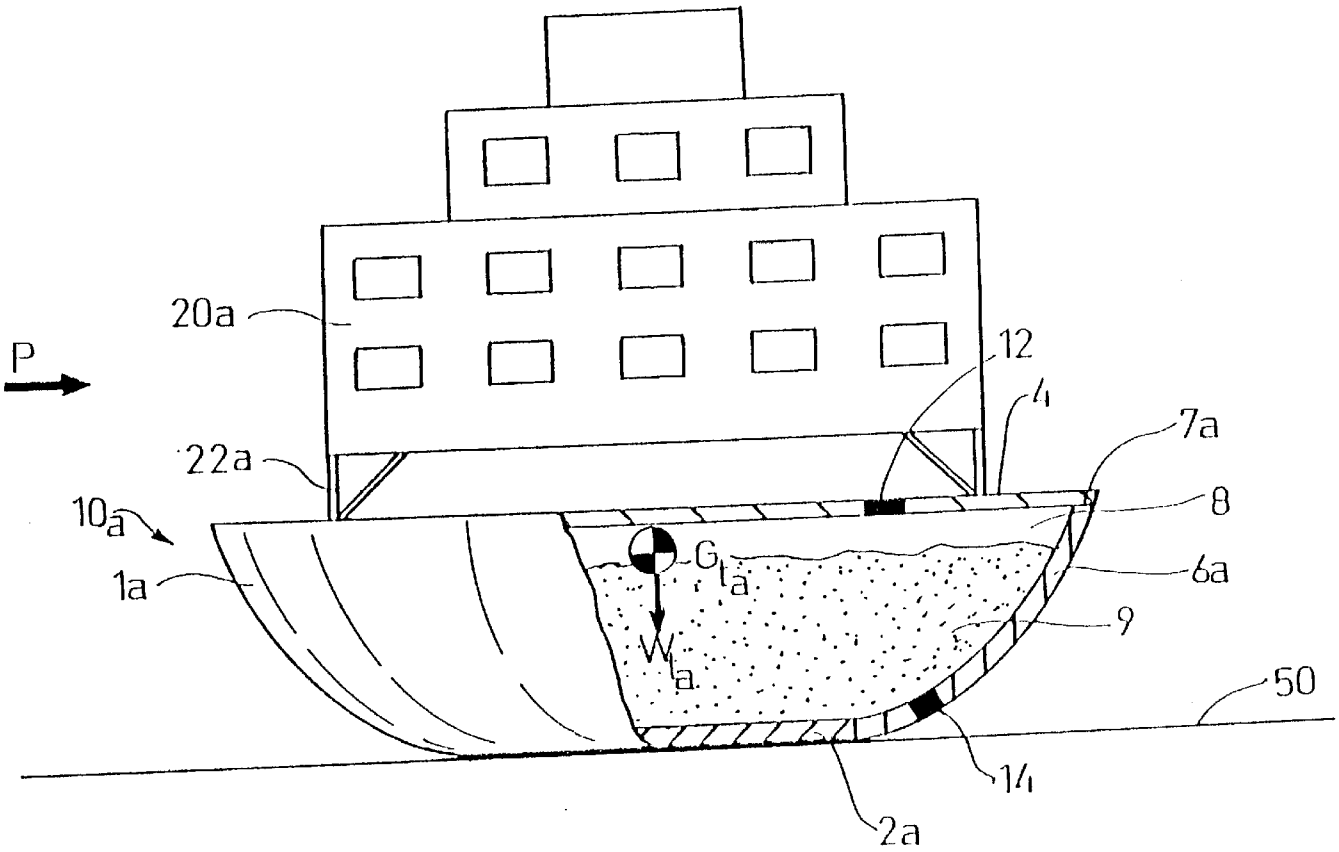
FIG. 4 illustrates the second embodiment of the present invention in partially fragmented side view.

Referring to FIG. 4, in a second embodiment of the present invention, the building support structure generally designated (10*a*) comprises a loadbearing shell (1*a*) defined by a horizontal, planar bottom base (2*a*) having a circular periphery, and an outwardly and upwardly sloping curved sidewalls (6*a*) joined thereto and extending therefrom to an upper portion (7*a*), forming a continuous frustro-convex sidewall surface. Said upper portion (7*a*) comprises an upper periphery parallel to the periphery of the said bottom base, and of a similar profile thereto, i.e., a horizontal circular periphery, and further comprises at said upper portion (7*a*) an upper wall (4) substantially parallel to said bottom base (2*a*) and suitably attached to said sidewalls (6*a*), and defining a sealable internal cavity (8) fillable with any suitable filler material (9). Said shell (1*a*) further comprises, on each of said upper wall (4) and said sidewalls (6*a*) (or said bottom base (2*a*)), at least one sealable opening, (12) and (14) respectively, wherein said filler material (9) may be introduced into, and removed from, said internal cavity (8) Suitable filler material (9) includes sand, aggregate, metal waste, water, building material waste and stone, and also includes concrete or reinforced concrete solidified in situ wherein to provide a solid concrete, or reinforced concrete, respectively, building support structure (10*a*). Thus, said filler material (9) provides ballast weight for the said building support structure (10*a*).

In the absence of external substantially horizontal forces, the said building support structure (10*a*) sits atop a substantially planar horizontal surface (50), with lower base wall (2*a*) in loadbearing contact thereto.

The shell (1*a*) further comprises suitable attachment means (22*a*) on the said upper wall (4) for rigidly mounting thereto a predetermined ancillary upper structure (20*a*) to form a combined structure, having dynamic properties of a corresponding rigid body, wherein relative movement between said ancillary upper structure (20*a*) and said building support structure (10*a*) is substantially prevented. Said upper structure (20*a*) is mounted onto said building support structure (10*a*) by means of said attachment means (22*a*), as has been described with reference to the first embodiment, mutatis mutandis, wherein the term "upper structure" has been defined hereinbefore.

Figure 5:
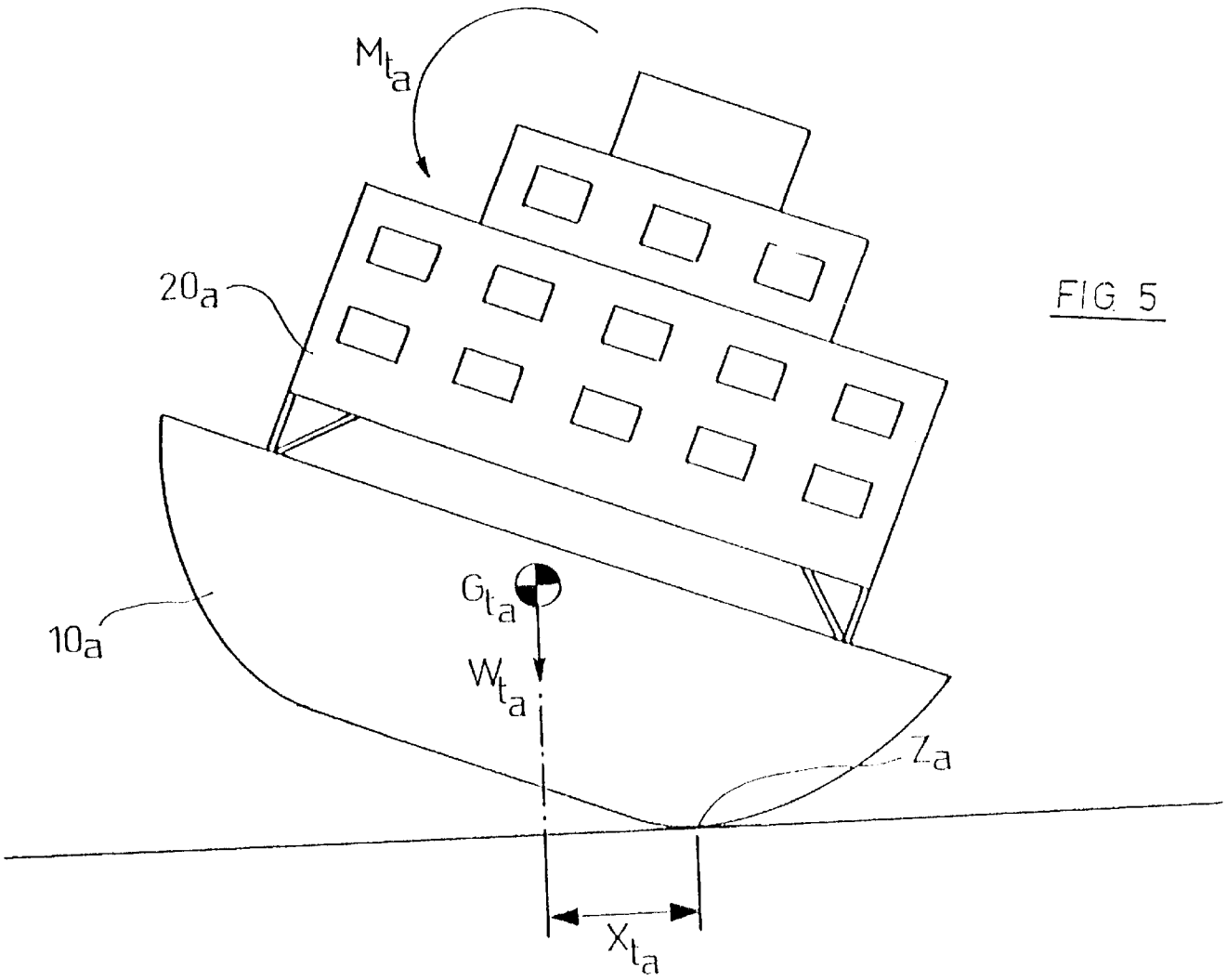
FIG. 5 illustrates the reverse rolling dynamics of the embodiment illustrated in FIG. 4.

Referring to FIG. 5, the second embodiment of the present invention operates in substantially the same manner as herein described with reference to the first embodiment, mutatis mutandis, with the exception that, at least for a predetermined range of roll angles, said self-righting means in this embodiment comprises the total weight (Wta) of the said building support structure including any said predetermined ancillary structure (i.e. said upper structure (20*a*)) that may be optionally rigidly attached thereto and further including the ballast weight of the said filler material (9), acting through the centre of gravity (Gta) thereof, wherein said centre of gravity (Gta) is horizontally displaced by a displacement (Xta) from the centre of said portion (za) of said sidewalls (6*a*) in loadbearing contact with the said surface (50), in a direction opposed to the direction of said predetermined horizontal force (P), wherein a net moment (Mta) is provided, given by:

$$(Mta)=(Wta)*(Xta)$$

i.e., the arithmetic product of said weight (Wta) and said displacement (Xta), said net moment (Mta) being positive in a direction opposed to the direction of said predetermined horizontal force (P), thereby enabling the combined structure to roll back to substantially the pre-roll position and orientation.

Figure 7:
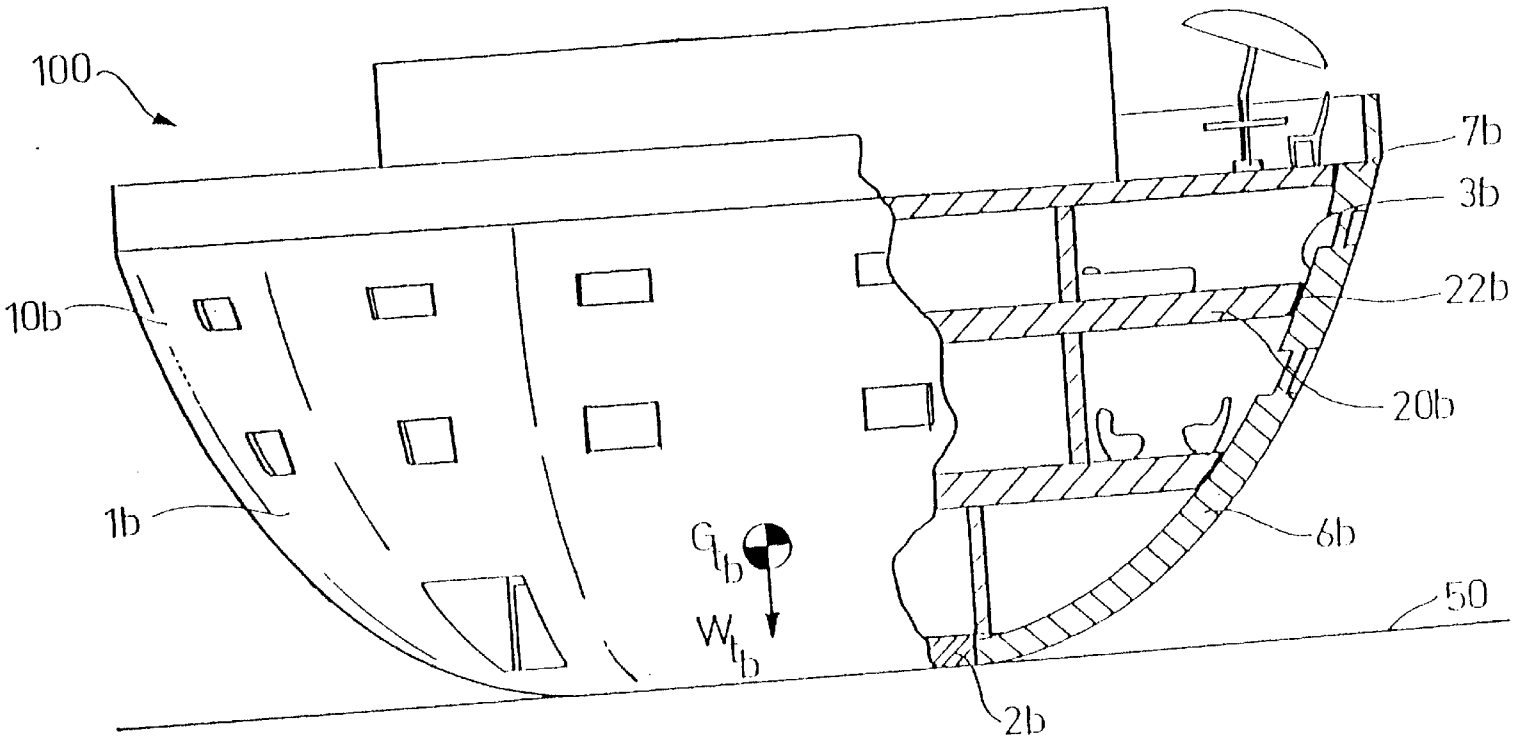
FIG. 7 illustrates a third embodiment of the present invention in partially fragmented side view.

Referring to FIG. 7, the present invention also relates to a dynamic building support structure wherein said loadbearing shell constitutes the outer walls of at least the bottom portion of an integrated building structure, wherein said outer walls may optionally further comprise openings for windows, doors, services and the like.

Thus, although the building support structure of the present invention has been described in the forgoing description relating to the first and second embodiments as a component, (10) and (10*a*) respectively, separate to the corresponding upper structure, (20) and (20*a*) respectively, this is not a necessary condition, and indeed the building support structure of the present invention may be incorporated into the design and construction of the building to provide one integral building structure. Thus, in a third embodiment of the present invention, a generalised building structure (100) comprises at least a lower portion (10*b*) thereof, comprising an external loadbearing shell (1*b*) defined by a horizontal, planar bottom base (2*b*) having a circular periphery, and an outwardly and upwardly sloping curved sidewalls (6*b*) joined thereto and extending therefrom to an upper portion (7*b*), forming a continuous frustro-convex sidewall surface. Said upper portion (7*b*) comprises an upper periphery parallel to the periphery of the said bottom base (2*b*), and of a similar profile thereto, i.e., a horizontal circular periphery. In the absence of external substantially horizontal forces, the said building structure (100) sits atop a substantially planar horizontal surface (50), with bottom base (2*b*) in loadbearing contact thereto.

Said structure (100) generally encompass all types of building sructures, including conventional and custom residential, business, industrial structures and also any service structures such as electric grid pylons and the like. Furthermore, said structure (100) may also comprise a multi-storey building, for example, wherein at least the lower floors of the building are incorporated into the said lower portion (10*b*). The shell (1*b*) may thus optionally further comprise suitable attachment means (22*b*) on the inner surface (3*b*) for rigidly mounting thereto a predetermined ancillary internal structure (20*b*) including inner floors, ceilings, and walls, according to the specific design and requirements of the said structure (100), and these are advantageously structurally compatible with the structural characteristics of the building support structure, hereinbelow described. The said internal structure (20*b*) is suitably mounted to said shell (1*b*) by means of said attachment means (22*b*) to form a combined structure, having dynamic properties of a corresponding rigid body, wherein relative movement between said ancillary inner structure (20*b*) and said building support structure (10*b*) is substantially prevented.

Figure 8:
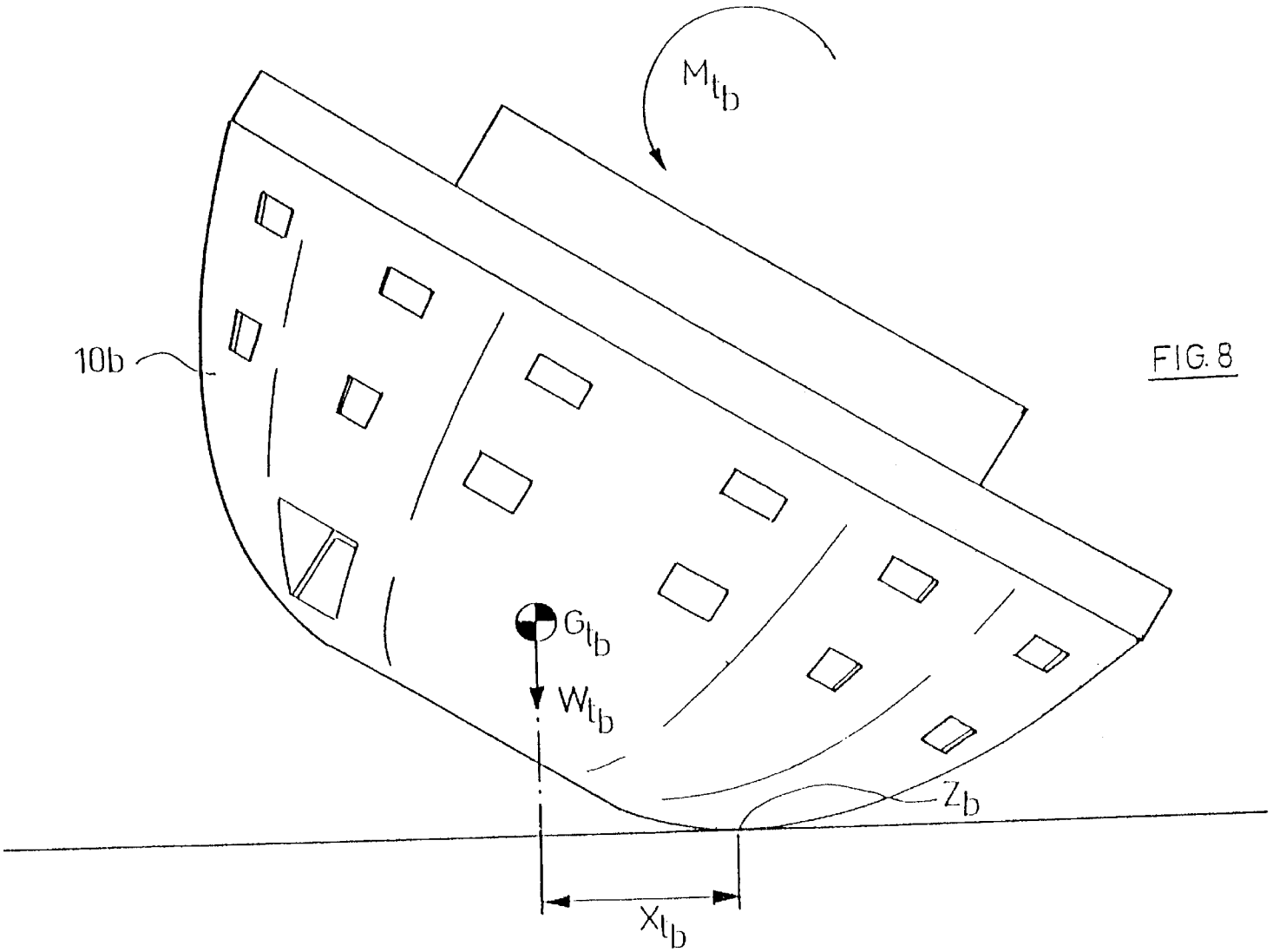
FIG. 8 illustrates the reverse rolling dynamics of the embodiment illustrated in FIG. 7.
Figure 9:
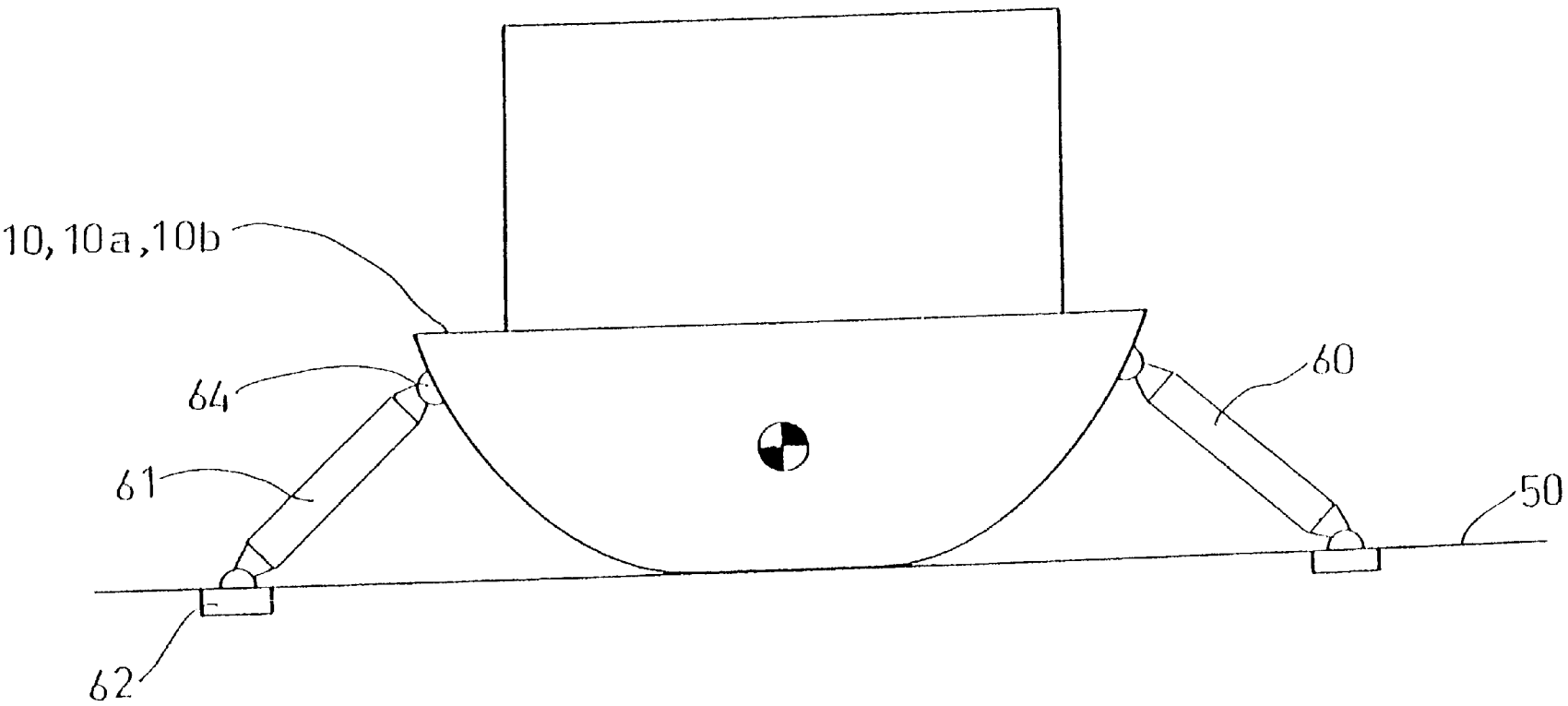
FIG. 9 illustrates an embodiment of the present invention optionally fitted with spring means.

Referring to FIG. 8, the third embodiment of the present invention operates in substantially the same manner as herein described with reference to the first and second embodiments, mutatis mutandis, wherein, at least for a predetermined range of roll angles, said self-righting means in this embodiment comprises the total weight (Wtb) of the said building support structure including any said predetermined ancillary structure (i.e. said internal structure (20*b*)) that may be optionally rigidly attached thereto acting through the centre of gravity (Gtb) thereof, wherein said centre of gravity (Gtb) is horizontally displaced by a displacement (Xtb) from the centre of said portion (zb) of said sidewall (6*b*) in loadbearing contact with the said surface (50), in a direction opposed to the direction of said predetermined horizontal force (P), wherein a net moment (Mtb) is provided given by:

$$(Mtb)=(Wtb)*(Xtb)$$

i.e., the arithmetic product of said weight (Wtb) and said displacement (Xtb), said net moment (Mtb) being positive in a direction opposed to the direction of said predetermined horizontal force (P).

Thus, the dimensions and weight distribution of the total building structure (100), particularly the lower portion (10*b*) thereof, are also chosen to ensure that the said net moment (Mtb) will remain positive, and therefor ensure that the said building structure (100) will roll back to a substantially upright position after termination of a horizontal force initially applied to it, in a similar manner to that hereinbefore described for the other embodiments of the present invention. Similarly, the lower portion (10*b*) of said structure (100) also conforms to the structural characteristics as hereinbelow described.

The said attachment means, (22), (22*a*) and (22*b*), with reference to the aforementioned first, second and third embodiments, respectively, depend on the nature and construction of the corresponding ancillary structure, and are each capable of transmitting loads from the corresponding ancillary structure (20), (20*a*) and (20*b*), respectively, to the external shell, (1), (1*a*) and (1*b*) respectively, of the corresponding building support structure, (10), (10*a*) and (10*b*) respectively, for the full range of roll angles. Examples of suitable attachment means (22), (22*a*) are common, and include conventional methods currently employed for mounting building structures on to conventional foundation structures. Examples of suitable attachment means (22*b*) are also very common in the art.

Typically, said shell, (1), (1*a*) or (1*b*), may be made from reinforced concrete, having a suitable thickness and further comprising internal strengthening ribs (not shown), if necessary, in order to conform to the structural characteristics hereinafter described, and methods and procedures for designing and constructing said shell, (1), (1*a*) and (1*b*), are well known in the art. A substantially rigid structure is thus provided for the corresponding building support structure, (10), (10*a*) or (10*b*) respectively, which being capable of independent motion relative to the surface on which it rests, enables the building support structure, (10), (10*a*) or (10*b*) respectively, and corresponding optional ancillary structure to "ride out" the effects of a seismic shock and/or liquefaction as a single body. Alternatively, said shell, (1), (1*a*) or (1*b*), may be made from any other suitable material or, combination of materials which enable the corresponding building support structure, (10), (10*a*) or (10*b*) respectively, to conform to the required structural characteristics, hereinbelow described. Preferably, the centre of gravity of the building support structure in each embodiment is symmetrically positioned as close as possible to the corresponding bottom base.

For each of the aforementioned embodiments, the said dynamic building support structure, (10), (10*a*) and (10*b*), thus comprises an external shell structure, (1), (1*a*) and (1*b*) respectively, wherein the corresponding bottom base, (2), (2*a*) and (2*b*) respectively, defines a circular periphery, and wherein said sidewalls, (6), (6*a*) and (6*b*) respectively, each define a frustro-convex external surface having substantially circular cross sections parallel to said bottom base, and arcuate profiles along planes perpendicular to said bottom base. The convex circular/arcuate shape of the corresponding said sidewalls, (6), (6*a*) and (6*b*) respectively, enables the rolling motion to occur along any vertical plane, thereby minimising any resistance to the rolling motion, and thus minimising structural stress following the application of a substantially horizontal force on the corresponding dynamic building structure, (10), (10*a*) and (10*b*) respectively.

Furthermore, for each of the aforementioned first second and third embodiments, the corresponding dynamic building support structure, (10), (10*a*) and (10*b*) respectively, comprises an external shell, (1), (1*a*) and (1*b*) respectively, wherein the corresponding said bottom base, (2), (2*a*) or (2*b*) respectively, and/or said sidewalls, (6), (6*a*) or (6*b*), respectively, further optionally enable the corresponding said building support structure, (10), (10*a*) or (10*b*) respectively, to translate over said surface (50) and/or to rotate about a vertical axis over said surface (50) when said predetermined force is applied to said building support structure, (10), (10*a*) or (10*b*) respectively.

Alternatively, for each of the aforementioned embodiments, the corresponding dynamic building support structure, (10), (10*a*) and (10*b*) respectively, comprises an external shell structure, wherein the corresponding bottom base defines a polygonal periphery, comprising at least four sides, and wherein the corresponding said sidewalls define a polygonal frustro-convex external surface having corresponding polygonal cross sections parallel to said bottom base, and arcuate profiles along planes perpendicular to said bottom base. Thus, the degrees of freedom in rolling, i.e., the number of vertical planes about which rolling may occur, is reduced from practically infinity to the number of sides (n) of the polygon constituting the periphery of corresponding base wall, wherein (n) is preferably an even integer not less than 4.

The structural characteristics of the building support structure for each of the foregoing embodiments include the following, and methods and techniques for designing and constructing a building support structure to conform to same are known in the art:

1. For each embodiment, said building support structure, (10), (10*a*) and (10*b*) respectively, is capable of supporting vertical loads such as the maximum weight, (Wt), (Wta) and (Wtb) respectively of the building support structure including any predetermined ancillary structure attached thereto, and normative mobile forces, when the line of action of the said maximum weight, (Wt), (Wta) and (Wtb) respectively, acting through the corresponding centre of gravity, (Gt), (Gta) and (Gtb) respectively, passes through:

a. the corresponding bottom base, (2), (2*a*) and (2*b*) respectively, in loadbearing contact with said surface (50); and b. any portion of said sidewalls, (6), (6*a*) and (6*b*) respectively, in loadbearing contact with said surface (50), i.e., for any given roll angle β°;

wherein said attachment means, (22), (22*a*) or (22*b*), enable said loads from corresponding ancillary structure, (20), (20*a*), and (20*b*) respectively, to be transmitted to the said shell, (1), (1*a*) or (1*b*) respectively.

2. Said building support structure, (10), (10*a*) and (10*b*) respectively, (including the corresponding ancillary structure) is capable of supporting dynamic loads arising from a rolling motion of said building support structure, (10), (10*a*) and (10*b*) respectively, over said surface (50).

3. The curvature of the corresponding sidewalls, (6), (6*a*) and (6*b*) respectively, enables said building support structure, (10), (10*a*) and (10*b*) respectively, to roll reversibly, along any vertical plane, over said surface (50).

Figure 10:
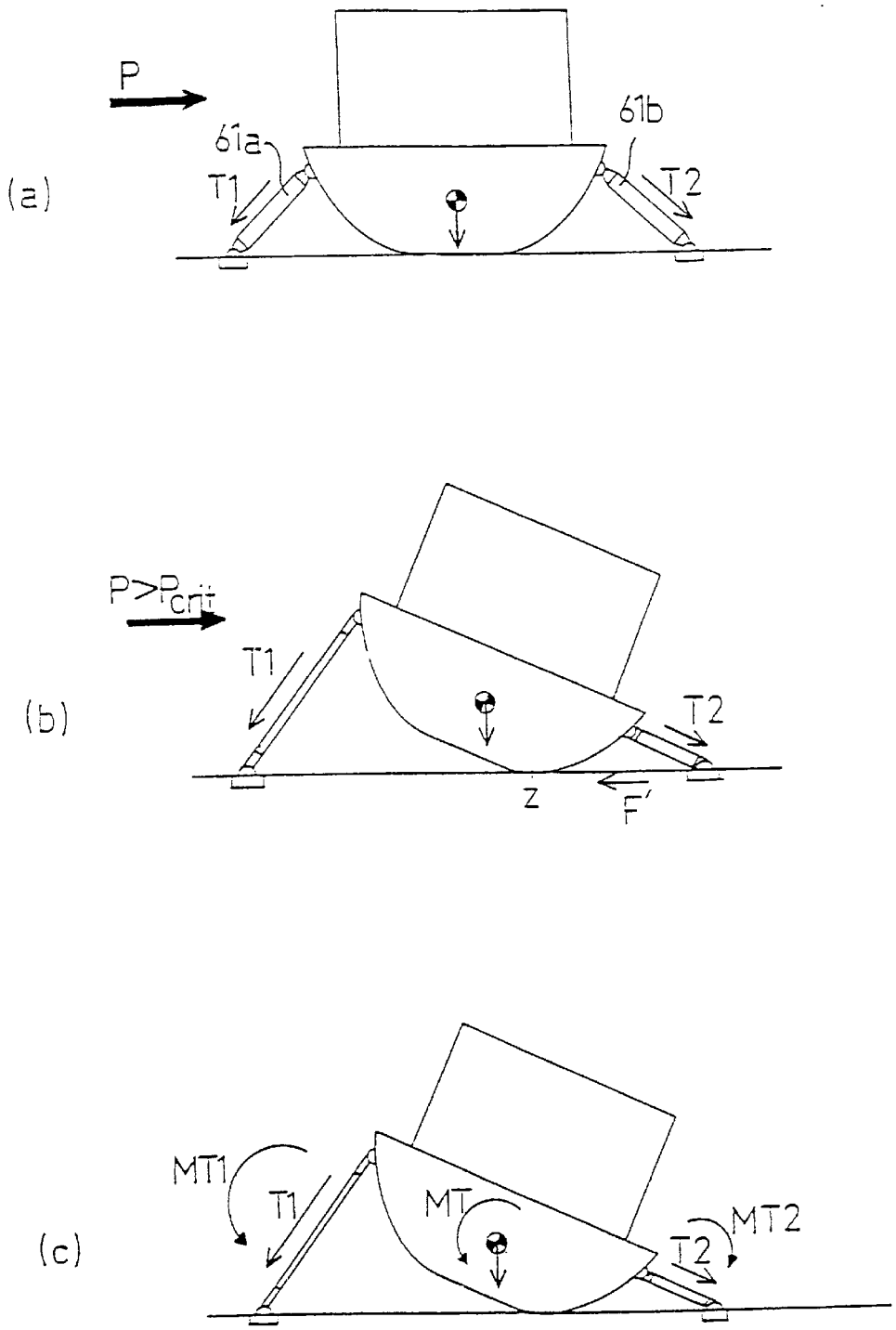
FIG. 10 illustrates the rolling dynamics of an embodiment of the present invention optionally fitted with spring means, during the application of a horizontal force, and after its subsequent withdrawal.

Optionally, and with reference to the first embodiment of the present invention, said building support structure (10) further comprises spring means (60), which may comprise, in one embodiment, at least three, and preferably more, suitable heavy duty helical steel springs (61) symmetrically disposed around the periphery of said building support structure (10), preferably in opposed pairs. In this embodiment, said springs (61) are suitably anchored at one end (62) to the said surface (50), and suitably mounted at the other end (64) to the said building support structure (10). Said spring means (60) are capable of converting at lest part of the energy associated with the application of a predetermined, substantially horizontal force to said building support structure (10) into internal elastic potential energy, which on removal of said force is subsequently released providing a positive net spring moment in a direction opposed to the direction of said force. FIG. 10 shows one such opposed pair of springs, (61*a*) and (61*b*) located on the same vertical plane. Said spring means (60) also enhance the lateral stability of the building support structure (10), including the corresponding optional ancillary upper structure (20), particularly during rolling motion of the same. Furthermore, said spring means (60) are also preferably pre-stressed, further enhancing said lateral stability. When a horizontal force (P) is applied to the said building support structure (10), the tensile stresses (T1) and (T2) in the two springs, (61*a*) and (61*b*) respectively, hitherto substantially equal, are redistributed, so that (T1) increases and (T2) decreases, as illustrated in FIG. 10(*a*), thereby increasing the stored elastic potential energy in (61*a*), and reducing the corresponding elastic potential energy in (61*b*). In addition, there is a redistribution of load on bottom base (2), similar to that hereinbefore described with reference to FIG. 2. At a predetermined value (Porit') of (P), the building support structure (10) (together with the corresponding ancillary structure (20)) will being to roll to a final roll angle which depends on the magnitude and duration of the horizontal force (P), the frictional forces (F') resisting the rolling motion, and the elastic properties and initial tensile state of each of the springs (61). When the horizontal force (P) is removed, the net moment (Mt) or ((Mp)−(Mu)) in a direction opposed to the direction of roll, as hereinbefore described, is further incremented by the moment due to the tension (T1) less that due to the tension (T2), represented by ((MT1)−(MT2)), which is provided by the difference in stored elastic potential energy between the springs (61*a*) and (61*b*). Preferably, (Mp) is greater than (Mu), wherein the self-righting means give rise to a positive moment (Mt), hereinbefore described, which is further enhanced by the positive net spring moment ((MT1)−(MT2)) provided by the said spring means (60). Further, the recovery characteristics of the building support structure (10) are improved, wherein the springs (61) help to dampen out vibrations due to the movement, and reduce the possibility of the rolling motion becoming complex and deviating from a single vertical plane. Alternatively, the spring means (60) constitute the self-righting means, providing the necessary positive moment ((MT1)−(MT2)) required when (Mp) is substantially similar to, or even less than, (Mu).

Springs (61*a*) and (61*b*) have been assumed to be aligned in the same vertical plane as the horizontal force (P). However, this is not a necessary condition, and similar rolling and restoration characteristics of the building support structure may be achieved even if the springs (61*a*) and (61*b*) are not so aligned, so long as there is at least a minimum of three springs (61) around the periphery of the building support structure (10).

Figure 11:
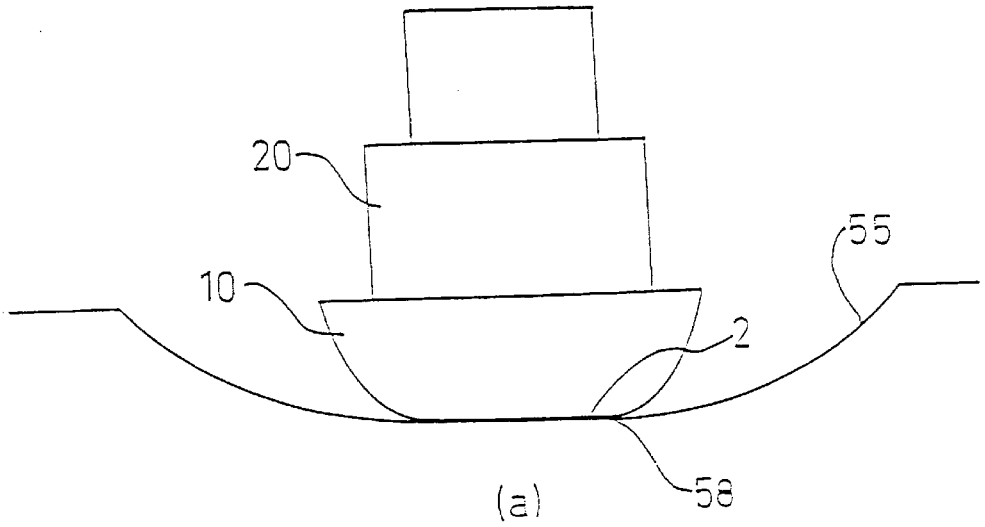
FIG. 11 illustrates the rolling dynamics of an embodiment of the present invention in loadbearing contact with an optional concave surface.
Figure 11:
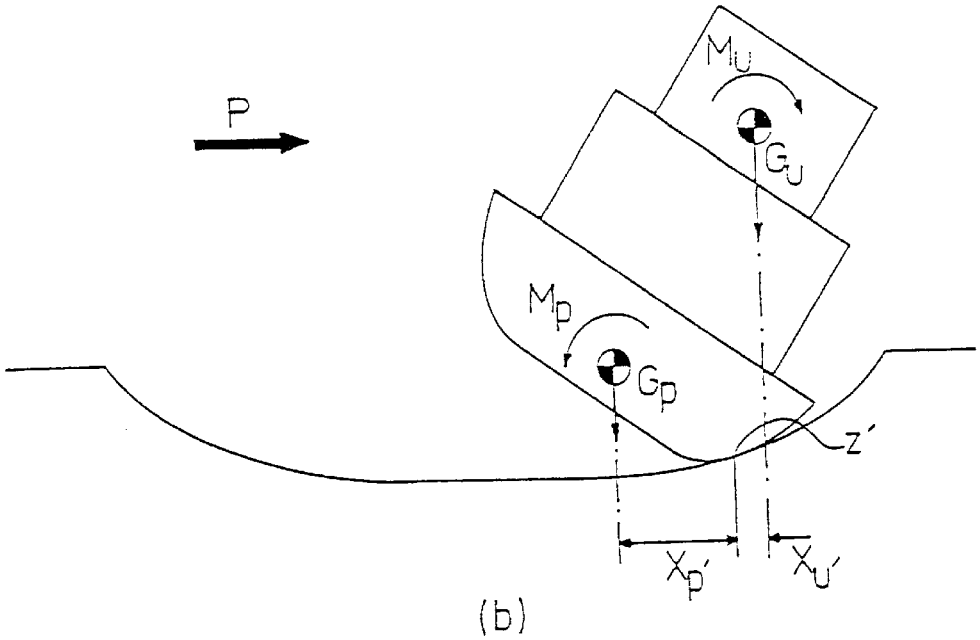

Optionally, and with reference to the first embodiment of the present invention, said building support structure (10) may be supported on a concave surface (55), having a smaller curvature than said sidewalls (6), and further comprising a lowermost nadir (58) having a complementary profile to said bottom base (2) enabling said building support structure (10) to be supported on said suitable surface (55) in a datum state of stable equilibrium, wherein said bottom surface (2) is in loadbearing contact with said nadir (58), and enabling the said building support structure (10) to roll thereon under the action of a predetermined horizontal force (P), FIG. 11. For any given roll angle β, the moment arm (Xp') of the weight (Wp) about the area (z') of loadbearing contact between the building support structure (10) and the surface (55) is greater than the corresponding moment arm (Xp) obtained when the building support structure rolls on a horizontal surface (50) (see FIG. 3). Thus, the moment (Mp'), given by:

$$(Mp')=(Wp)*(Xp')$$

is greater than the corresponding said moment (Mp), given hereinbefore by:

$$(Mp)-(Wp)*(Xp)$$

Conversely, the moment arm (Xu') of the weight (Wu) about (z') is reduced in relation to the corresponding moment arm (Xu). Thus the moment (Mu'), given by:

$$(Mu')=(Wu)*(Xu')$$

is lower than the corresponding moment (Mu), given hereinbefore by:

$$(Mu)=(Wu)*(Xu)$$

Hence the net positive moment ((Mp')−(Mu')) obtained on a concave surface (55) is advantageously greater than that obtained on a corresponding planar surface (50). Also, since the effective area of contact (z') between the building support structure (10) and the concave surface (55) is greater the corresponding area of contact (z) with a planar surface (50), the local stresses on the building support structure (10) are reduced. This is advantageous in enhancing the structural integrity of the same, or alternatively in providing a weaker, and less expensive, building support structure (10) having the required characteristics.

Although the optional spring means (60) and optional concave surface (55) have been described in relation to the first embodiment of the present invention, the description also applies, mutatis mutandis, to the other forgoing embodiments of the present invention.

The present invention also relates to a method for building an earthquake-proof building structure comprising the steps of:

(I) providing an external loadbearing shell including a bottom base and upwardly and outwardly sloping curved sidewalls extending from the periphery of said base to an upper portion, wherein:

(i) said bottom base enables said building structure to be supported on a suitable surface in a datum state of stable equilibrium, wherein said bottom base is in loadbearing contact with same; and (ii) said sidewalls define a suitable curvature for enabling said building structure to roll reversibly about a horizontal axis over said surface, wherein at least a portion of said sidewalls is in loadbearing contact therewith;

(II) providing self-righting means capable of generating a net moment in a direction opposed to the direction of rolling of said building structure in the absence of external forces;

(III) providing suitable attachment means within said building structure for rigidly mounting therein a predetermined internal structure, wherein to form a combined structure having dynamic properties of a corresponding rigid body;

wherein said loadbearing shell constitutes the outer walls of at least the bottom portion of said building structure, wherein said outer walls may further comprise a plurality of openings for windows, doors, services and the like, and wherein said building structure is in a datum state of steady equilibrium until an external substantially horizontal predetermined force is applied thereto, whereby:

(a) said building structure topples and rolls reversibly over said surface, thereby substantially absorbing the impact energy associated with said horizontal force and minimising corresponding impact stresses on, and substantially preserving the structural integrity of said building structure; and (b) said self-righting means return the said building structure to said datum state of steady equilibrium state after said external horizontal force is removed.

Furthermore, said bottom base and/or said sidewalls further optionally enable said building structure to translate over said surface and/or rotate about a vertical axis over said surface when said predetermined force is applied to said building support structure.

The present invention also relates to a method for building an earthquake-proof building support structure for a predetermined building structure, comprising the steps of:

(I) providing an external loadbearing shell including a bottom base and upwardly and outwardly sloping curved sidewalls extending from the periphery of said base to an upper portion, wherein:

(i) said bottom base enables said building support structure to be supported on a suitable surface in a datum state of stable equilibrium, wherein said bottom base is in loadbearing contact with same; and (ii) said sidewalls define a suitable curvature for enabling said building support structure to roll reversibly about a horizontal axis over said surface, wherein at least a portion of said sidewalls is in loadbearing contact therewith;

(II) providing self-righting means capable of generating a net moment in a direction opposed to the direction of rolling of said building support structure in the absence of external forces;

(III) providing suitable attachment means on said building support structure for rigidly mounting said building structure onto said building support structure, wherein to form a combined structure having dynamic properties of a corresponding rigid body;

wherein said combined structure is in a datum state of steady equilibrium until an external substantially horizontal predetermined force is applied thereto, whereby:

(a) said building support structure topples and rolls reversibly over said surface, thereby substantially absorbing the impact energy associated with said horizontal force and minimising corresponding impact stresses on, and substantially preserving the structural integrity of, said combined structure; and (b) said self-righting means return the said combined structure to said datum state of steady equilibrium state after said external horizontal force is removed.

Furthermore, said bottom base and/or said sidewalls further optionally enable said building support structure to translate over said surface and/or rotate about a vertical axis over said surface when said predetermined force is applied to said building support structure.

The present invention also relates to a method for building an earthquake-proof building support structure for a plurality of predetermined building structures, comprising the steps of:

(I) providing an external loadbearing shell including a bottom base and upwardly and outwardly sloping curved sidewalls extending from the periphery of said base to an upper portion, wherein:

(i) said bottom base enables said building support structure to be supported on a suitable surface in a datum state of stable equilibrium, wherein said bottom base is in loadbearing contact with same; and (ii) said sidwalls define a suitable curvature for enabling said building support structure to roll reversibly about a horizontal axis over said surface, wherein at least a portion of said sidewalls is in loadbearing contact therewith;

(II) providing self-righting means capable of generating a net moment in a direction opposed to the direction of rolling of said building support structure in the absence of external forces;

(III) providing suitable attachment means on said building support structure for rigidly mounting said plurality of building structures onto said building support structure, wherein to form a combined structure having dynamic properties of a corresponding rigid body;

wherein said combined structure is in a datum state of steady equilibrium until an external substantially horizontal predetermined force is applied thereto, whereby:

(a) said building support structure topples and rolls reversibly over said surface, thereby substantially absorbing the impact energy associated with said horizontal force and minimising corresponding impact stresses on, and substantially preserving the structural integrity of, said combined structure; and (b) said self-righting means return the said combined structure to said datum state of steady equilibrium state after said external horizontal force is removed.

Furthermore, said bottom base and/or said sidewalls further optionally enable said building support structure to translate over said surface and/or rotate about a vertical axis over said surface when said predetermined force is applied to said building support structure.

Although only a few embodiments have been described in detail in the foregoing description, the present invention is not limited thereto, and is only defined by the scope of the appended claims.

What is claimed is:

1. An above-surface topple-able and self-righting dynamic building support structure comprising:

(I) an external loadbearing shell including a bottom base and upwardly and outwardly sloping curved sidewalls extending from the periphery of said base to an upper portion, wherein:

(i) said loadbearing shell constitutes the outer walls of at least the bottom portion of an integrated building structure wherein said outer walls further comprise openings for windows, doors, services and the like;

(ii) said bottom base enables said building support structure to be supported on a suitable surface, independent from said structure, in a datum state of stable equilibrium; and (iii) said sidewalls define a suitable curvature for enabling said building support structure to roll reversibly about a substantially horizontal axis over said surface;

(II) self-righting means capable of generating a net moment in a direction opposed to the direction of rolling of said building support structure in the absence of external forces;

wherein said building support structure is in a datum state of steady equilibrium until an external substantially horizontal predetermined force is applied thereto, whereby:

(a) said building support structure topples and rolls reversibly over said surface, thereby substantially absorbing the impact energy associated with said horizontal force and minimizing corresponding impact stresses on, and substantially preserving the structural integrity of, said building support structure including any predetermined ancillary structure that may be rigidly attached thereto; and (b) said self-righting means return said building support structure to said datum state of steady equilibrium state after said external horizontal force is removed.

2. A dynamic building support structure as claimed in claim 1, wherein said bottom base and/or said sidewalls further optionally enable said building support structure to translate over said surface and/or rotate about a vertical axis over said surface when said predetermined force is applied to said building support structure.

3. A dynamic building support structure as claimed in claim 1, wherein said upper portion comprises an upper periphery parallel to the periphery of said bottom base, and of a similar profile thereto.

4. A dynamic building support structure as claimed in claim 3 wherein said bottom base defines a circular periphery, and wherein said sidewalls define a frustro-convex external surface having substantially circular cross sections parallel to said bottom base, and arcuate profiles along planes perpendicular to said bottom base.

5. A dynamic building support structure as claimed in claim 3 wherein said bottom base defines a polygonal periphery, comprising at least four sides, and wherein said sidewalls define a polygonal frustro-convex external surface having corresponding polygonal cross sections parallel to said bottom base, and arcuate profiles along planes perpendicular to said bottom base.

6. A dynamic building support structure as claimed in claim 1 wherein said shell is made from reinforce concrete.

7. A building support structure as claimed in claim 4 wherein for at least a predetermined range of roll angles, said self-righting means comprises the total weight of said building support structure including any said predetermined ancillary structure that may be optionally rigidly attached thereto, acting through the centre of gravity thereof, wherein said centre of gravity is horizontally displaced by a displacement from the centre of said portion of said sidwalls in loadbearing contact with said surface, in a direction opposed to the direction of said predetermined horizontal force, wherein to provide a net moment given by the arithmetic product of said weight and said displacement, said net moment being positive in a direction opposed to the direction of said predetermined horizontal force.

8. A building support structure as claimed in claim 1 wherein for at least a predetermined range of roll angles, said self-righting means comprises the weight of said building support structure including any said predetermined ancillary structure that may be optionally rigidly attached thereto, further including the ballast weight of said filler material, acting through the centre of gravity thereof, wherein said centre of gravity is horizontally displaced by a displacement from the centre of said portion of said sidwalls in loadbearing contact with said surface, in a direction opposed to the direction of said predetermined horizontal force, wherein to provide a net moment given by the arithmetic product of said weight and said displacement, said net moment being positive in a direction opposed to the direction of said predetermined horizontal force.

9. A building support structure as claimed in claim 1, further comprising spring means suitably anchored at a first end thereof to said surface and suitably mounted at a second end thereof to said building support structure, wherein said spring means are capable of converting at least part of energy associated with the application of said predetermined horizontal force to said building support structure into elastic potential energy, which on removal of said horizontal force is subsequently released providing a positive net spring moment in a direction opposed to the direction of said horizontal force.

10. A building support structure as claimed in claim 8, wherein said structure is supported on a suitable surface, said structure further comprising spring means anchored at a first end thereof to said surface and mounted at a second end thereof to said building support structure, wherein said spring means are capable of converting at least part of energy associated with the application of said predetermined horizontal force to said building support structure into elastic potential energy, which on removal of said horizontal force is subsequently released providing a positive net spring moment in a direction opposed to the direction of said horizontal force.

11. A building support structure as claimed in claim 10, wherein said net moment provided by said self-righting means is further enhanced by the positive net spring moment provided by said spring means.

12. A building support structure as claimed in claim 9, wherein said spring means comprise at least three suitable helical steel springs symmetrically disposed around the periphery of said building support structure.

13. A building support structure as claimed in claim 9, wherein said spring means enhance the lateral stability of said building support structure in particular during rolling motion of the building support structure.

14. A building support structure as claimed in claim 9, wherein said spring means are pre-stressed.

15. A building support structure as claimed in claim 1, wherein said structure is supported on a suitable surface, and wherein said surface is substantially planar and horizontal.

16. A building support structure as claimed in claim 1, wherein said structure is supported on a suitable surface, and wherein said surface is concave, having a smaller curvature than said sidewalls, further comprising a lowermost nadir having a complementary profile to said bottom base, enabling said building support structure to be supported on said suitable surface in a datum state of stable equilibrium, wherein said bottom surface is in loadbearing contact with said nadir.

17. A dynamic building support structure as claimed in claim 1 further comprising at said upper portion an upper wall substantially parallel to said bottom base and suitably attached to said sidewalls, and defining a sealable internal cavity fillable with any suitable filler material.

18. A dynamic building support structure as claimed in claim 17 further comprising at least one scalable opening on each of said upper wall and said sidewall or said bottom base, wherein said filler material may be introduced into, and removed from, said internal cavity.

19. A dynamic building support structure as claimed in claim 17, wherein said filler material provides ballast weight therein.

20. A dynamic building support structure as claimed in claim 17 wherein said filler material is chosen from among sand, aggregate, metal waste, water, building material waste and stone.

21. A dynamic building support structure as claimed in claim 17 further comprising suitable attachment means for rigidly mounting thereto a predetermined ancillary upper structure, to form a combined structure having dynamic properties of a corresponding rigid body, wherein relative movement between said ancillary upper structure and said building support structure is substantially prevented.

22. A building support structure as claimed in claim 21, wherein said building support structure further comprises a predetermined ancillary upper structure mounted thereto by means of said attachment means to form a combined structure having dynamic properties substantially similar to that of a corresponding rigid body, wherein relative movement between said ancillary upper structure and said building support structure is substantially prevented.

23. A dynamic building support structure as claimed in claim 1, further comprising suitable attachment means for rigidly mounting thereto a plurality of predetermined ancillary upper structures, to form a combined structure having dynamic properties of a corresponding rigid body, wherein relative movement between each said plurality of upper structures and said building support structure is substantially prevented.

24. A building support structure as claimed in claim 1, wherein said plurality of predetermined ancillary upper structures is mounted onto said building support structure.

25. A building support structure as claimed in claim 1, wherein said upper structure includes any building and service structures.

26. A building support structure as claimed in claim 1, wherein said integrated building structure comprises any suitable building or service structures.

27. A building support structure as claimed in claim 1, wherein an external substantially horizontal predetermined force is applied to said structure, and wherein said horizontal force results from a seismic disturbance.

28. An above-surface topple-able and self-righting dynamic building support structure comprising:

(I) an external loadbearing shell including a bottom base and upwardly and outwardly sloping curved sidewalls extending from the periphery of said base to an upper portion, and further comprising at said upper portion an upper wall substantially parallel to said bottom base and suitably attached to said sidewalls, and defining a sealable internal cavity fillable with any suitable filler material, wherein:

(i) said bottom base enables said building support structure to be supported on a suitable surface, independent from said structure, in a datum state of stable equilibrium; and (ii) said sidewalls define a suitable curvature for enabling said building support structure to roll reversibly about a substantially horizontal axis over said surface;

(II) self-righting means capable of generating a net moment in a direction opposed to the direction of rolling of said building support structure in the absence of external forces;

wherein said building support structure is in a datum state of steady equilibrium until an external substantially horizontal predetermined force is applied thereto, whereby:

(a) said building support structure topples and rolls reversibly over said surface, thereby substantially absorbing the impact energy associated with said horizontal force and minimizing corresponding impact stresses on, and substantially preserving the structural integrity of, said building support structure including any predetermined ancillary structure that may be rigidly attached thereto; and (b) said self-righting means return said building support structure to said datum state of steady equilibrium state after said external horizontal force is removed; and a dynamic building support structure wherein said filler material includes concrete or reinforced concrete solidified in situ.

29. A method for building an earthquake-proof building structure comprising the steps of:

(I) providing a substantially planar surface;

(II) providing an external loadbearing shell including a bottom base and upwardly, and outwardly sloping curved sidewalls extending from the periphery of said base to an upper portion, wherein:

(i) said bottom base enables said building structure to be supported on said surface independent from said structure in a datum state of stable equilibrium; and (ii) said sidewalls define a suitable curvature for enabling said building structure to roll reversibly about a horizontal axis over said surface, (III) providing self-righting means capable of generating a net moment in a direction opposed to the direction of rolling of said building structure in the absence of external forces;

(IV) providing suitable attachment means within said building structure for rigidly mounting therein a predetermined internal structure, wherein to form a combined structure having dynamic properties of a corresponding rigid body;

wherein said loadbearing shell constitutes the outer walls of at least the bottom portion of said building structure, wherein said outer walls further comprise a plurality of openings for windows, doors, services and the like, and wherein said building structure is in a datum state of steady equilibrium until an external substantially horizontal predetermined force is applied thereto;

whereby:

(a) said building structure topples and rolls reversibly over said surface, thereby substantially absorbing the impact energy associated with said horizontal force and minimising corresponding impact stresses on, and substantially preserving the structural integrity of said building structure; and (b) said self-righting means return said building structure to said datum state of steady equilibrium state after said external horizontal force is removed.

30. A method for building an earthquake-proof building structure as claimed in claim 29, whereby said bottom base and/or said sidewalls further enable said building support structure to translate over said surface and/or rotate about a vertical axis over said surface when said predetermined force is applied to said building support structure.

* * * * *